US007692093B2

(12) United States Patent
Tonucci

(10) Patent No.: US 7,692,093 B2
(45) Date of Patent: Apr. 6, 2010

(54) HIGH TEMPERATURE HIGH VOLTAGE CABLE

(75) Inventor: Ronald J Tonucci, Waldorf, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 12/368,584

(22) Filed: Feb. 10, 2009

(65) Prior Publication Data

US 2009/0200061 A1 Aug. 13, 2009

Related U.S. Application Data

(60) Provisional application No. 61/027,933, filed on Feb. 12, 2008.

(51) Int. Cl.
*H01B 11/06* (2006.01)

(52) U.S. Cl. ..... 174/36

(58) Field of Classification Search ..... 174/36, 174/110 R, 113 R, 110 A, 110 PM, 120 R, 174/120 SC, 121 R, 122 R, 122 G, 124 G, 174/126.1

See application file for complete search history.

(56) References Cited

U.S. PATENT DOCUMENTS

| | | | | |
|---|---|---|---|---|
| 4,495,691 | A * | 1/1985 | Masumoto et al. | 29/527.5 |
| 4,620,432 | A * | 11/1986 | Stepanenko et al. | 72/73 |
| 5,139,820 | A * | 8/1992 | Sawada et al. | 427/120 |
| 5,431,800 | A * | 7/1995 | Kirchhoff et al. | 204/403.01 |
| 5,436,409 | A * | 7/1995 | Sawada et al. | 174/120 C |
| 5,473,113 | A | 12/1995 | Aldissi | |
| 6,060,162 | A * | 5/2000 | Yin et al. | 428/372 |
| 6,441,737 | B1 * | 8/2002 | Antonenco et al. | 340/572.1 |
| 6,556,139 | B2 * | 4/2003 | Manov et al. | 340/572.6 |
| 6,711,329 | B2 * | 3/2004 | Zelesnik | 385/100 |
| 7,002,072 | B2 * | 2/2006 | Tonucci et al. | 174/36 |
| 7,241,953 | B2 | 7/2007 | Glew | |
| 2004/0118583 | A1 | 6/2004 | Tonucci et al. | |
| 2006/0237221 | A1 * | 10/2006 | Glew | 174/146 |

FOREIGN PATENT DOCUMENTS

| | | |
|---|---|---|
| EP | 1065674 | 1/2001 |

OTHER PUBLICATIONS

PCT Search Report and Written Opinion in PCT/US09/33715, Apr. 9, 2009.

* cited by examiner

*Primary Examiner*—William H Mayo, III
(74) *Attorney, Agent, or Firm*—John J. Karasek; Joseph T. Grunkemeyer

(57) ABSTRACT

A cable having one or more conductive members and one or more strength members. Each conductive member has a metal microwire having an outer diameter and an inorganic cladding having an inner diameter. The microwire is positioned within the cladding, and the outer diameter of the microwire is at least about 2 microns less then the inner diameter of the cladding. Each strength member has a plurality of inorganic fibers surrounding the conductive members or an inorganic rod. The conductive members are conductive while applying a voltage of 5000 V to the conductive members and while exposing the cable to a temperature of about 1000° C.

11 Claims, 3 Drawing Sheets

HIGH TEMPERATURE HIGH VOLTAGE CABLE

The application claims the benefit of U.S. Provisional Patent Application No. 61/027,933, filed Feb. 12, 2008. This provisional application and all other publications and patent documents referenced throughout this nonprovisional application are incorporated herein by reference.

TECHNICAL FIELD

The disclosed article is generally related to electrical cables.

DESCRIPTION OF RELATED ART

High voltage (HV) cables are typically composed of polymer coated copper wires, and a polymer jacket for strength and encapsulation. At temperatures above the decomposition temperature of the polymer(s), the electrical properties and strength of the cable fail, typically at temperatures below 450° C.

Tonucci et al. (U.S. Pat. No. 7,002,072 and US Pat. Appl. Pub. No. 2004/0118583) teaches a microwire which may remain conductive at voltages of 10,000 V or temperatures of 1500° C.

BRIEF SUMMARY

Disclosed herein is a cable comprising one or more conductive members and one or more strength members. Each conductive member comprises a metal microwire having an outer diameter and an inorganic cladding having an inner diameter. The microwire is positioned within the cladding, and the outer diameter of the microwire is at least about 2 microns less then the inner diameter of the cladding. Each strength member comprises a plurality of inorganic fibers surrounding the conductive members or an inorganic rod. The conductive members are conductive while applying a voltage of 5000 V to the conductive members and while exposing the cable to a temperature of about 1000° C.

BRIEF DESCRIPTION OF THE DRAWINGS

A more complete appreciation of the invention will be readily obtained by reference to the following Description of the Example Embodiments and the accompanying drawings.

DETAILED DESCRIPTION OF EXAMPLE EMBODIMENTS

Figure 1:
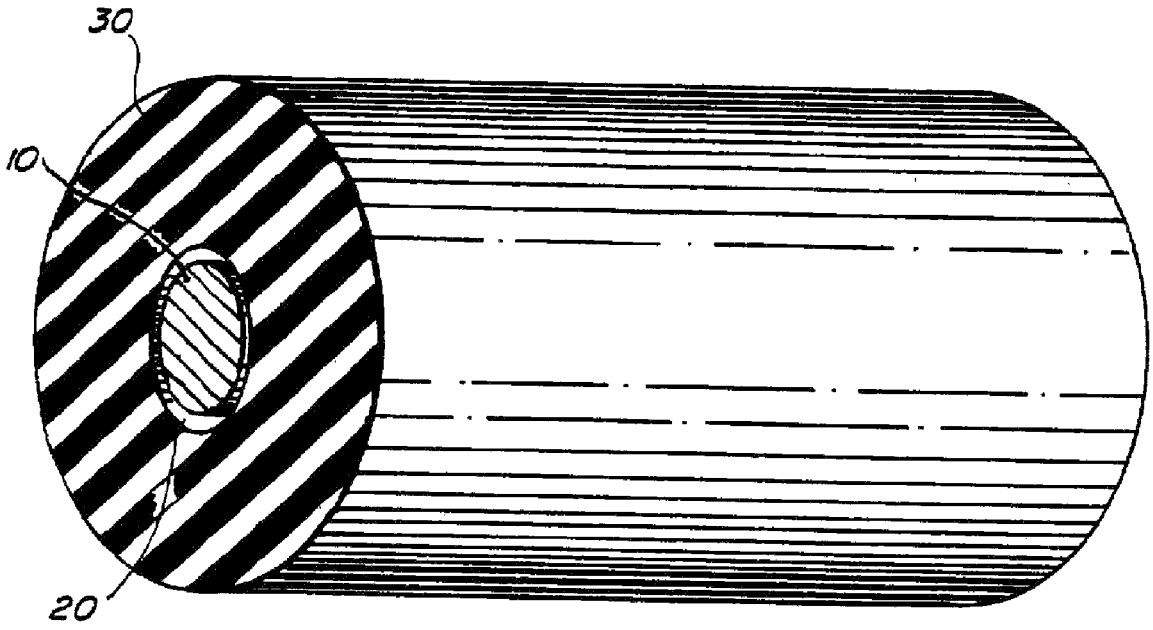
FIG. 1 is a schematic cross-sectional representation of an embodiment of a conductive member.

In the following description, for purposes of explanation and not limitation, specific details are set forth in order to provide a thorough understanding of the present disclosure. However, it will be apparent to one skilled in the art that the present subject matter may be practiced in other embodiments that depart from these specific details. In other instances, detailed descriptions of well-known methods and devices are omitted so as to not obscure the present disclosure with unnecessary detail.

Loss of critical communications and power deployment in harsh environments resulting from excess heat, fire, jet engine exhaust, etc., on board ship, aircraft, or other platforms can result in catastrophic failure of the entire platform. The cable described herein can be capable of doubling the usable temperature range of typical high voltage (HV) cables and a means of greatly improving the strength performance of such cables at high temperatures (HT).

The HV HT cable electrical conductors are composed of one or more microwires (U.S. Pat. No. 7,002,072) that may be operable at high voltage (to 10,000 volts) and high temperature (to 1000° C.) with a functional tensile strength up to 400,000 PSI. These parameters are not independent. Fused synthetic silica and fused quartz are good electrical insulators. Flexible fused synthetic silica (FSS) rods are used, for example as main structural supports and can operate at temperatures to 1100° C. The tensile strength of FSS materials can exceed 800,000 psi at room temperature. FSS or quartz, roving or yarns (e.g. Saint Gobain), for example, are braided around the microwire(s) and rods to keep the core structure stabilized and operate at temperatures to 1100° C. The roving and yarn braids also supply additional strength over the operational temperature range of the cable. The fused quartz (or fused synthetic silica) yarns and rovings are composed of very small diameter filaments, typically in the range of 8 to 15 microns, that allow rapid thermal changes in the cable cross section with minimal induced stress in these supporting strength members. A ZYLON® (poly(p-phenylene-2,6-benzobisoxazole) or other HT high strength polymer over braid can reduce abrasion while the cable is in contact with its environment. The glass rods may be coated with a suitable polymer such as polyimide to reduce abrasion internal to the cable. The entire cable may have a diameter about 50 mil to about 100 mil, including about 60 mil.

Optic fibers made of FSS may also be added to the structure for optical communication without reduction in strength of the cable. Unbraided FSS filler (roving or yarn) may be added linearly (i.e. in parallel to other cable components) to the cable to increase flexibility and/or fill voids, while maintaining, or increasing, the cable strength at elevated temperature. In the HV HT cable the conductors, glass rods, optical fibers, roving, and yarns may all contribute to the strength of the cable and are operational at temperatures in excess of 1000° C. The cable can be configured using various permutations of the materials listed above. Additional high temperature components can be added to the cable as other functionality requires. Examples of additional components that could be added to the cable include: rods and/or braiding material composed of other high temperature glasses, ceramics or metals.

The conductive members are the wire described in U.S. Pat. No. 7,002,072. FIG. 1 schematically illustrates the cross-section of an embodiment of the conductive member. A microwire 10 is surrounded by a cladding 30. There is a gap 20 between the microwire 10 and the cladding 30.

The microwire is a very thin metal wire. Such microwires are known in the art. Microwires inherently have an outer diameter. The maximum outer diameter of microwires is generally considered to be about 1000 μm. Microwires with outer diameters as small as 1-10 μm or less are also known. Microwires are commercially available in a variety of metals and diameters, although the present cable is not limited to commercially available microwires.

Suitable microwires can have outer diameters in the range of, but not limited to, about 1 μm to about 250 μm. The microwire can comprise any solid metal. The microwire can also comprise an alloy or other combination such as a coating of one metal on another metal or a composite of two or more dissimilar metals. One possible composite structure is a core-clad structure. This may be made by inserting a rod of one metal into tube of another metal. The microwire than comprises the core-clad composite. An advantage of the core-clad composite is that the core can be a cheap, more electrically conductive or lower melting point metal such as silver or copper. The cladding can be a more expensive metal that resists oxidation, such as platinum or a metal with a higher melting point such as tungsten, molybdenum, iridium, or rhenium. Suitable metals for the microwire can include, but are not limited to one or more metals selected from the group consisting of copper, silver, gold, platinum, tungsten, molybdenum, rhenium, rhenium/platinum alloy, high temperature metals, and alloys and composites thereof.

The microwire may be made by providing a metal microwire having an outer diameter; providing an inorganic tube having an inner diameter larger than the outer diameter of the microwire; drawing the tube through a heating zone at draw process parameters such that the inner diameter of the drawn portion of the tube is reduced; inserting the microwire into the drawn portion of the tube, whereby the drawn portion of the tube becomes a cladding around the microwire; and adjusting the draw process parameters such that the inner diameter of the cladding is larger than the outer diameter of the microwire, and the microwire and the cladding are not in contact with each other under thermal conditions that would cause bonding between the microwire and the cladding.

In the step of providing an inorganic tube, the tube is a hollow cylinder. The cylinder inherently has an inner diameter. Inorganic tubes are commercially available in a variety of inorganic materials and diameters, although the invention is not limited to commercially available tubing. The tube may also comprise different materials in different areas of the tube. For example, the tube may have a "starter" zone at one end that comprises a material useful for beginning the drawing process, while the rest of the tube comprises the desired insulating material. The tube may also be a graded seal material, where there is a gradient of the composition of the tube along the length of the tube. In these cases, the softening point of the tube may vary along the length of the tube. This may allow or require changing the draw process parameters during the course of the drawing.

Suitable tubes can have inner diameters in the range of but not limited to, about 0.25 inches to about 1.5 inches. The inner diameter is larger than the outer diameter of the microwire. The thickness of the tube is chosen by reference to the desired thickness of the cladding. The ratio of the inner and outer diameters of the cladding may be about the same as the ratio of the inner and outer diameters of the tube. The major limitation on the size of the tube is the ability of the drawing equipment to reduce inner diameter of the tube to the appropriate size. The tube comprises an inorganic material which has a softening temperature that can be, but is not limited to, lower than the melting point of the metal. Suitable inorganic materials can include, but are not limited to, one or more materials selected from the group consisting of fused silica, fused quartz, alumina, a glass, and combinations thereof. Fused silica in highly pure form is a particularly strong material with excellent dielectric, thermal, and mechanical properties.

In the step of drawing the tube, the tube is drawn through a heating zone in a manner similar to the way optic fibers are reduced in diameter, at draw process parameters such that the inner diameter of the drawn portion of the tube is reduced to about the same size as the outer diameter. The draw process parameters can include, but are not limited to, heating zone temperature and profile, drawing speed, feed speed, atmosphere, and tube material. The tube is softened within the heating zone, and stretched during the drawing process. This makes the tube narrower and reduces the inner diameter. An inert atmosphere may be used to avoid metal oxidation and reduce the number of hydroxyl groups that could weaken the properties of the cladding material.

After a portion of the tube has been drawn, the microwire is inserted into the tube. The insertion is done such that continued drawing of the tube will also pull the microwire. The insertion may comprise contacting the microwire to the inside of the drawn tube by adjusting the draw process parameters to further reduce the inner diameter of the drawn portion of the tube. The inserting step may also be performed before or simultaneously with the drawing step, although the microwire may not be immediately pulled with the tube. The microwire may also have a leader portion on the end inserted into the tube. The leader may be a wire that can withstand higher temperatures than the microwire. The use of a leader may allow for heating the tube to a higher temperature such that it can be baited-off rapidly. Once the process parameters have been set, the leader can end and the microwire can be drawn into the tube. The leader may be attached to the microwire by any means, and may even be attached while the process is running. The portion of the drawn tube that surrounds the microwire is then referred to as a cladding.

In the adjusting step, the draw process parameters are then adjusted Such that the inner diameter of the cladding is larger than the outer diameter of the microwire. This results in a gap between the microwire and the cladding all the way around the microwire. This gap is present at all points along the wire where the thermal conditions would cause bonding between the microwire and the cladding. If the cladding temperature is too high, such as when the glass is softened, the hot cladding may bond to the microwire if they were allowed to touch. By keeping the microwire centered or concentric within the larger cladding while they are hot, bonding can be prevented. When the cladding and microwire arc sufficiently cool, it is no longer necessary to maintain the gap all the way around the microwire. The cooled microwire may then touch the cooled cladding without causing bonding.

The size of the gap can be controlled by appropriate adjustment of the draw process parameters. If the inner diameter was about the same as the outer diameter in the drawing step or the inserting step, then the drawing speed would be reduced in the adjusting step. The reduction in drawing speed increases the inner diameter of the cladding. If the gap is too large during the drawing step, the drawing speed would be increased. If the gap is already the desired size, then the adjusting step can comprise maintaining the draw process parameters as they were during the drawing step or the inserting step. The cladding can have an inner diameter in the range of, but not limited to, about 3 μm to about 290 μm. The difference in diameters may be, but is not limited to, from about 2 μm to about 40 μm. The adjusting step may also comprise a change of tube material, as when the tube is not homogenous, such as a graded seal.

Once the adjustment has been done, the draw process parameters can be maintained while more microwire and tube is fed into the heating zone, producing a continuous length of wire without any bonding between the microwire and the cladding. The result can be a wire comprising a metal microwire and an inorganic cladding. The microwire is positioned within the cladding and the outer diameter of the microwire is less then the inner diameter of the cladding. The microwire and the cladding are substantially not bonded to each other. Bonding refers to any molecular or atomic level force that holds the microwire and the cladding together. Bonding also refers to a substantial detrimental change in the chemical, thermal, or mechanical properties of the wire or cladding as a result of contact at temperatures that cause such changes, even if the contact is only temporary. Bonding does not refer to mere touching or mechanical forces, such as when the cooled wire is in a configuration that presses the microwire and the cladding together and friction makes sliding one against the other difficult. The term "substantially" indicates that there is a portion of wire that is free of bonding for at least a length that is useful for applications requiring an insulated conducting microwire. Suitable portions include, but are not limited to, at least about 1 cm, at least about 30 cm, at least about 10 m, at least about 400 m, and at least about 600 m. Some bonding is within the scope of the claimed wire if it is limited to defects or portions that are intended to be cut from the wire to be used. For example, a length of wire may include a leader portion with bonding that is to be cut off before use. There may be bonding at intervals, either intentionally or due to defects, if these bonded areas may be cut out, yielding usable portions of wire that are free of bonding.

The drawing temperature is not necessarily restricted by the melting point of the metal in the microwire. The microwire should not melt during the process. This is easily done at temperatures below the melting point of the metal. This can also be done at higher temperatures by pulling the microwire through the heating zone fast enough that is does not have time to melt before returning to lower temperatures. When the microwire comprises a core-clad composite, it may only be necessary to avoid melting the cladding, while allowing the core to temporarily melt during the drawing process.

Due to the small diameter, the conductive member may be flexible. As used herein, the term "flexible" refers to the ability to bend the conductive member according to methods known in the art. It is also possible to manufacture the conductive member in long lengths of at least 30 cm and up to 400 meters and longer. The conductive member may be capable of conducting current while subjected to a potential of at least about 1000 V and a temperature of at least about 500° C. without dielectric breakdown. The conductive member may withstand even more severe conditions such as 5000 V at 840° C. or 1000° C., 10,000 V at 650° C., and 1000 V at 1500° C.

The presence of the gap during the draw process may be responsible for the high temperature, high voltage properties of the wire. The following descriptions of the mechanism by which the gap improves the performance of the wire are proposed mechanisms. The proposed mechanisms do not limit the scope of the claimed cable. The gap may help to offset the effects of differential thermal expansion of the microwire and the cladding. If the microwire and the cladding were bonded together or physically attached, thermal expansion could cause fracture or failure of the cladding. When there is no bonding between them, each can expand without being constrained by the other. This can also be the basis for maintaining the flexibility of the wire.

The gap may also avoid contact and diffusion of metal onto and/or into the cladding during the drawing process. The drawing process may take place at temperatures high enough that any metal in contact with the cladding may stick onto and/or diffuse into the cladding. Such metal contamination can adversely affect the physical and electrical properties of the cladding. The cladding may lose strength as well as dielectric properties. Since the gap is present during the drawing process, there is no metal in contact with the cladding while at elevated temperatures and therefore minimal to no metal diffusion. Prevention of contamination is particularly important where the cladding is fused silica, as its mechanical and dielectric properties are very sensitive to contamination. Once wire has cooled, there may be contact between the microwire and the cladding without bonding. This may not adversely affect either the mechanical or electrical properties of the wire.

Certain contaminants in the silica may by useful. Fused silica doped with 4+ ions such as $Ti^{4+}$ and $Ce^{4+}$ can have a lower softening point and can make the glass mechanically stronger. The doping level may be less than 0.2%. The softening point can be reduced from over 2000° C. to about 1600° C. This may be useful when the microwire comprises molybdenum, as molybdenum can become brittle when heated to 2000° C. These ions have very little mobility so there is minimal reduction in dielectric and mechanical strength. A similar effect may be achieved with phosphorous doped silica. Other suitable materials include, but are not limited to, a doped glass and $F^-$ doped silica.

The cladding can be strengthened by placing a coating on its surface. The coating can comprise, but is not limited to, one or more materials selected from the group consisting of polyimide, a polymer, an organic coating, and an inorganic coating. The coating may allow the wire to be handled after the drawing process without breaking the wire. The wire may be wound onto a spool, incorporated into a device, or otherwise handled. The coating may both strengthen the wire and protect the cladding from scratching and from materials that may contaminate the cladding.

The coating may not be necessary to the electrical properties of the wire. In a decoy towline, the coating may be polyimide. The polyimide can protect the wire when the wire is spooled, unwound, incorporated into the towline, and deployed. Once the towline is deployed and exposed to the jet engine plume, the polyimide may decompose and expose the cladding. However, the polyimide is not needed to obtain the electrical properties needed for the wire in the towline and is not needed for strength once the towline is deployed. Polyimide decomposes cleanly. The decomposition products may not contaminate the cladding.

The strength member of the cable can be any inorganic fiber or rod that maintains the physical integrity of the cable under high temperature conditions, such as up to about 1000° C. Suitable materials include, but are not limited to, fused synthetic silica, silicon carbide oxide, silicon carbide, or aluminum oxide. Silicon carbide oxide fiber may have ultra-fine β-SiC crystallites and an amorphous mixture of silicon, carbon, and oxygen. In general, less oxygen in the fiber can result in a greater tensile modulus, but at the expense of higher electrical conductivity. In the event of a failure of the cladding on the microwire, a conductive strength member in contact with the microwire may cause an electrical short. Silicon carbide oxide fibers have 12 wt % oxygen can have an appropriate balance of tensile strength and low conductivity. NICALON™ fibers, including CG and HVR grades, (COI Ceramics, Inc.) are suitable fibers for use in the cable.

Figure 2:
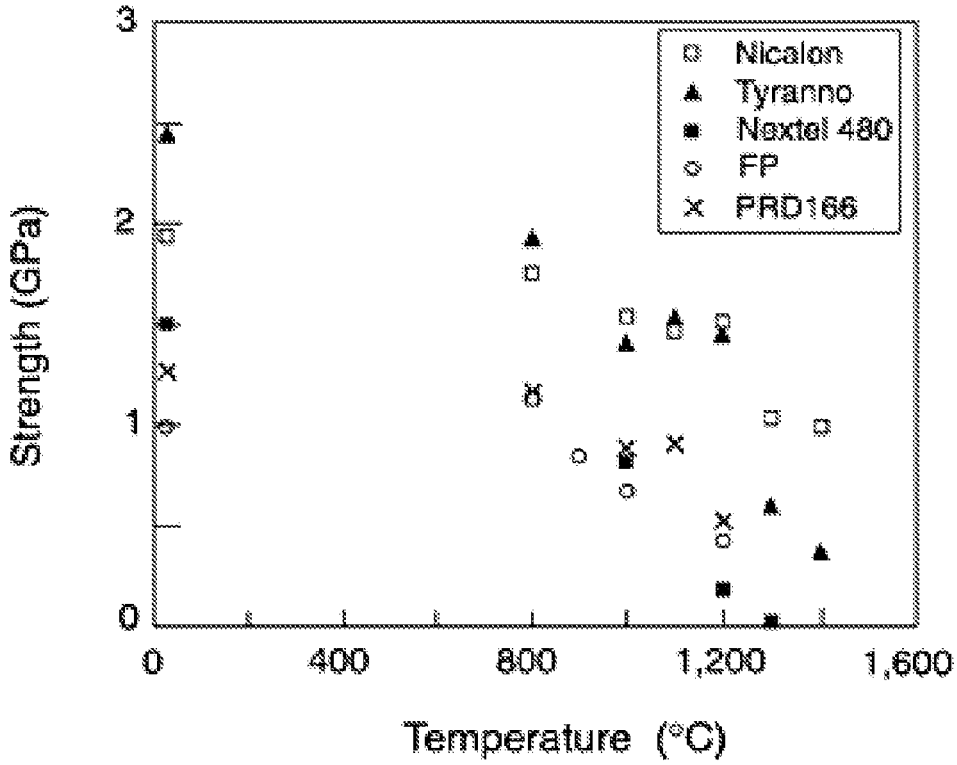
FIG. 2 shows a graph of the strength of SiC based fibers at elevated temperatures.

FIG. 2 shows a graph of the strength of SiC based fibers at elevated temperatures (source: Pysher et al., "Strengths of ceramic fibers at elevated temperatures" *J. Am. Cer. Soc.,* 72(2), 284-288 (1989). Tables 1 and 2 show the properties a number of fibers suitable for use in the cable, depending on the use conditions of the cable (source for all but [a]: *Advanced Materials for the Twenty-First Century* Committee on Advanced Fibers for High-Temperature Ceramic Composites. National Materials Advisory Board. Commission on Engineering and Technical Systems. National Research Council (National Academy Press Washington, D.C. 1998). In general, there is no loss in the strength of the fibers due to thermal cycling.

TABLE 1

| trade name | manufacturer | composition (wt %) | diameter (μm) | fibers/tow | elastic modulus (GPa) | strength (GPa) | electrical conductivity |
|---|---|---|---|---|---|---|---|
| Fiber FP | DuPont | >99% $\alpha$-$Al_2O_3$ | 20 | 200 | 380 | 1.38 | |
| PRD-166 | DuPont | ~80% $\alpha$-$Al_2O_3$ ~20% $ZrO_2$ | 20 | 200 | 380 | 2.3 | |
| Nextel 312 | 3M | 62% $Al_2O_3$ 24% $SiO_2$ 14% $B_2O_3$ | 10-12 | 740-780 | 150 | 1.7 | |
| Nextel 720 | 3M | 85% $Al_2O_3$ 15% $SiO_2$ | 10-12 | | 260 | 2.1 | |
| Nextel 550 | 3M | 73% $Al_2O_3$ 27% $SiO_2$ | 10-12 | | 193 | 2.0 | |
| Nextel 610 | 3M | 0.2-0.3% $SiO_2$ 0.4-0.7% $Fe_2O_3$ >99% $\alpha$-$Al_2O_3$ | 14 | 390 | 373 | 2.93 | |
| Almax | Mitsui Mining | >99% $\alpha$-$Al_2O_3$ | 10 | 1000 | 210 | 1.8 | |
| Altex | Sumitomo | 85% $\gamma$-$Al_2O_3$ 15% $SiO_2$ | 16 | 1000 | 193 | 2.0 | |
| Saphikon | Saphikon | 100% $Al_2O_3$ | 125 | 1 | 470 | 3.5 | |
| CG Nicalon | Nippon-Carbon | 57% Si 32% C 12% O | 14 | 500 | 210 | 3.0 | $10^3$ Ω-cm |
| HVR Nicalon | Nippon-Carbon | 57% Si 32% C 12% O | 14 | 500 | 180 | 2.8 | $>10^6$ Ω-cm |
| Nicalon NL 200 | Nippon-Carbon | 57% Si 31% C 12% O | 14 | 500 | 230 | 3.0 | $10^3$-$10^4$ Ω-cm |
| Hi-Nicalon | Nippon-Carbon | 62% Si 32% C 0.5% O | 14 | 500 | 270 | 2.8 | 1.4 Ω-cm |
| Hi-Nicalon-S | Nippon-Carbon | 68.9% Si 30.9% C 0.2% O | 12 | 500 | 420 | 2.6 | 0.1 Ω-cm |
| Tyranno Lox M | Ube | 55.4% Si 32.4% C 10.2% O 2% Ti | 11 | 800 | 187 | 3.3 | 30 Ω-cm |
| Tyranno ZM | Ube | 55.3% Si 33.9% C 9.8% O 1.0% Zr | 11 | 800 | 192 | 3.3 | 10 Ω-cm |
| Sylramic | Dow-Corning | 66.6% Si 28.5% C 2.3% B 2.1% Ti 0.8% O 0.4% N | 10 | 800 | 380 | 3.2 | |
| SiBN(C) | Bayer | $SiBN_3C$ with 1-3% O | 8-14 | 300 | 358 | 3.0 | insulating |
| Tonen | Tonen | 58% Si, 37% N 4% O, trace C | 10 | | 250 | 2.5 | |
| SCS-6 | Textron | SiC on C | 140 | 1 | 390 | 4.0 | |
| UF SiC | University of Florida/3M | SiC, 1.17% O | 10-12 | 120 | 210-240 | 2.8 | |

TABLE 2

| trade name | prime composition | 1000 max use temp (° C.) (rupture strength = 100 MPa) | 1000 max use temp (° C.) (rupture strength = 500 MPa) |
|---|---|---|---|
| Nicalon NL200 | Si—C—O | <1300 | <1100 |
| Hi-Nicalon | Si—C | <1400 | 1200 |
| Tyranno Lox M | Si—C—O—Ti | n/a | n/a |
| Sylramic | SiC, $TiB_2$ | >1400 | 1200 |
| Tonen | Si—N—C | n/a | n/a |
| SCS-6 | Si—C | >1400 | <1300 |
| Altex | $Al_2O_3$—$SiO_2$ | n/a | n/a |
| Nextel 312 | $Al_2O_3$—$SiO_2$—$B_2O_3$ | n/a | n/a |
| Nextel 610 | $Al_2O_3$ | 950 | 850 |
| Nextel 720 | $Al_2O_3$—$SiO_2$ | 1050 | 950 |
| Almax | $Al_2O_3$ | n/a | n/a |
| Saphikon | $Al_2O_3$ (single crystal) | >1,400 | 1250 |

Figure 3:
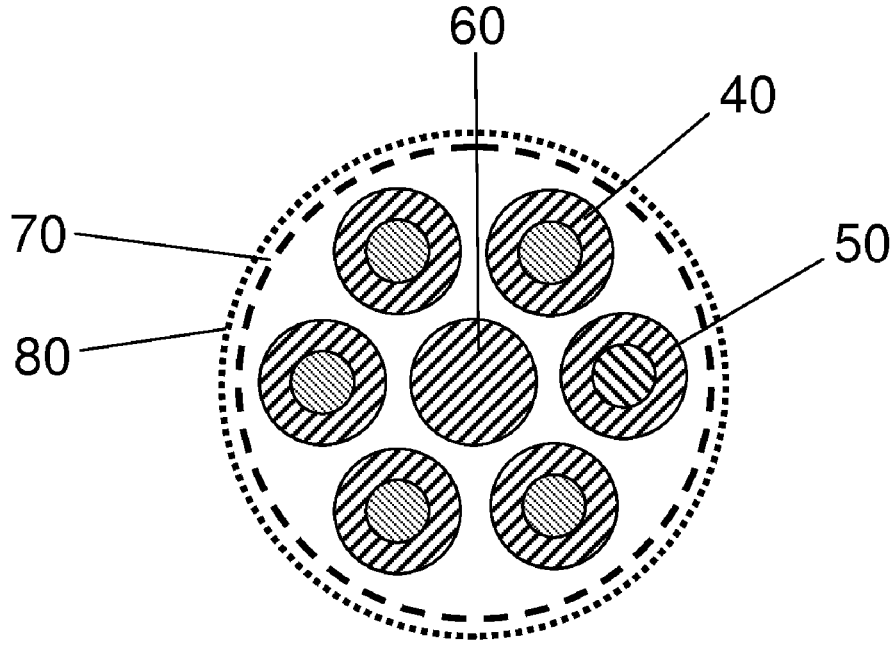
FIGS. 3-6 show various configurations of a cable.
Figure 4:
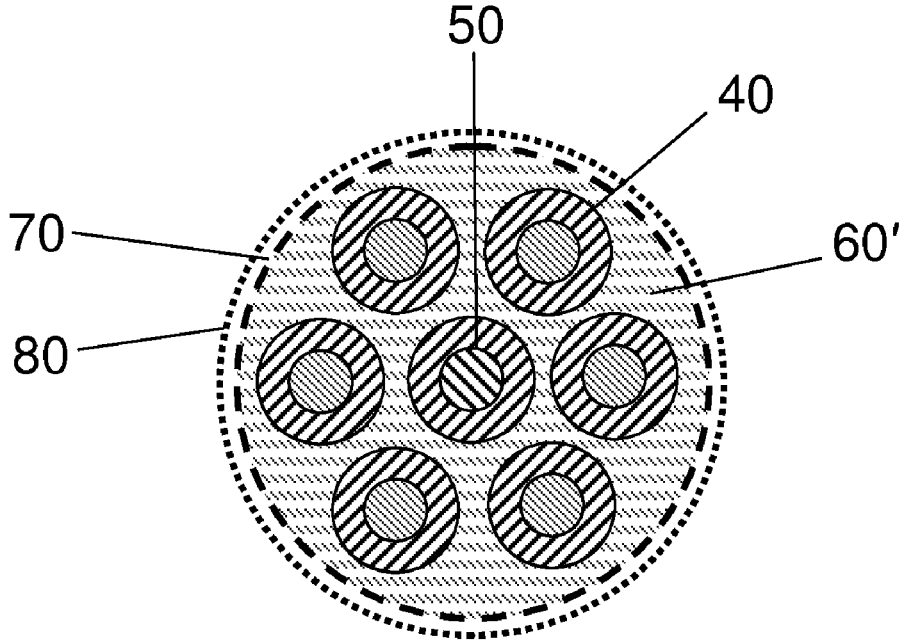

The strength member may be in the form of a flexible rod running the length of the cable or in fibers as a braiding or roving that fills the space of the cable or surrounds the cable. The cable may also contain optical fibers that remain functional at high temperatures. Such optical fibers are known in the art. The strength member may also be an optical fiber. The cable may then be surrounded by a ZYLON® braiding to hold the cable together and promote sliding of the cable against itself. This braiding may be decomposed at high temperatures, but may no longer be needed once in the high temperature environment. FIGS. 3 and 4 show example configurations of the cable. Each cable contains conductive members 40, optical fibers 50, strength member 60, glass braiding 70, and ZYLON® braiding 80. In FIG. 3, the strength member 60 is a glass rod, such as a FSS rod. In FIG. 4, the strength member 60' is a glass filler roving, such as FSS roving. The number and arrangement of conductive members and optical fibers and the number, arrangement, and type of strength members shown may vary from that shown.

The cable may also contain a spline to protect the conductive members. Under certain conditions, such as being reeled over a pulley, the tensile stress on the cable may cause constriction of any over braid, which may in turn compress and damage the conductive members and optical fibers. A spline is a structure that runs along the length of the cable and contains a number of ridges protruding from a central core. The ridges protrude from the center of the cable further than the conductive members. The conductive members and any optical fibers or strength members may be positioned between the ridges of the spline. In this configuration shown in FIG. 5, any compression of the fiber is born by the spline 60", protecting the conductive members. The ridges of the spine may have any shape, as long as the ridge has portions that are further from the center of the cable than all parts of the conductive members. Such a spline may also be used in other cables.

Figure 5:
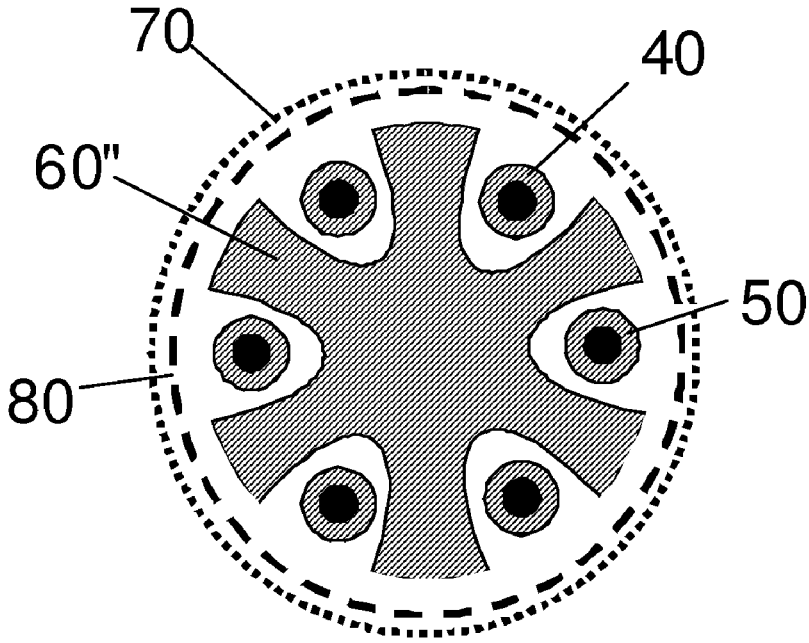

In FIG. 5, the spline is also the strength member. Such splines may comprise, for example, silicon carbide or silicon carbide oxide. However, the spline need not be the strength member, but may be a high temperature polymer instead, for example ZYLON®. This may be used when any compression of the conductive members takes place before the high temperature use of the cable, such that the spline is no longer needed at high temperatures.

The cable may retain its strength and conductive properties at temperatures up to about 1000° C. At that temperature, the cable may have a tensile strength of at least about 70,000 psi, while the conductive members simultaneously remain conductive at about 5000 V. The cable may have utility in communications and power deployment in harsh environments resulting from excess heat, fire, jet engine exhaust, etc., on board ship, submarines aircraft or other platforms where loss of critical communications and power can result in catastrophic failure of the entire platform. The cable should also provide fire protection on ship (where maximum temperatures should not exceed 800° C.) and other platforms. This cable also has considerable strength at elevated temperatures depending upon the choice of construction components and their cross section. Strength at temperatures exceeding 1000° C. have been recorded and hence this cable can be used as a strength member for tow line applications in which the cable is required to carry power, signal, and a pay load at elevated temperatures. Other example applications where communications, power, and strength of materials are desired over a wide range of temperatures and harsh environments include buildings, safes, controlled environments, space craft, and satellites.

The following examples are given to illustrate specific applications. These specific examples are not intended to limit the scope of the disclosure in this application.

EXAMPLE

Figure 6:
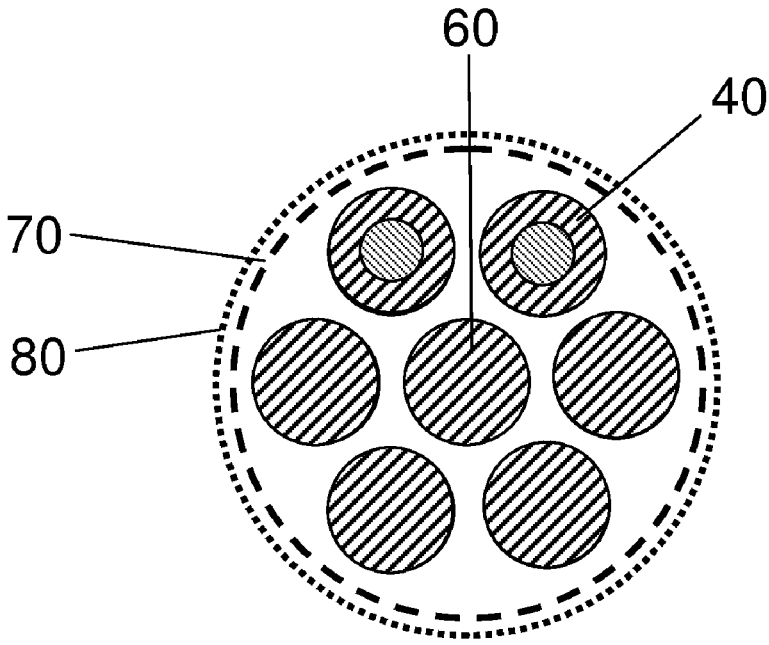

The HV HT cable below was fabricated. A high voltage test to 8,000 V at room temperature was completed. The cable was Fabricated by re-spooling microwire (U.S. Pat. No. 7,002,072), with an outside diameter of 260 microns, onto 2 spools each 200 meters in length. Fused synthetic silica glass rods containing a polyimide cladding and an outside diameter of 260 microns were re-spooled onto 5 spools. The 7 spools were placed inside a device that cabled the microwire and silica rods into the configuration shown in FIG. 6, such that the 2 microwires would be side by side during the cabling process. The pitch on the 6 microwires and rods surrounding the center rod was approximately 1 inch. The resulting cable was then braided with 12 pics of silica glass (Saint Gobain) yarn and an over braid of Zylon, also containing 12 pics. The braiding material was between 150 and 300 denier. After the cabling and braiding process, the microwires within the cable maintained continuity from end to end (approximately 800Ω each) and no cross talk between microwires was observed (limit of METEX model M-3860D digital multimeter resistance scale).

Obviously, many modifications and variations are possible in light of the above teachings. It is therefore to be understood that the claimed subject matter may be practiced otherwise than as specifically described. Any reference to claim elements in the singular, e.g., using the articles "a," "an," "the," or "said" is not construed as limiting the element to the singular.

What is claimed is:

1. A cable comprising:

one or more conductive members, each conductive member comprising:

a metal microwire having an outer diameter; and an inorganic cladding having an inner diameter;

wherein the microwire is positioned within the cladding;

wherein the outer diameter of the microwire is at least about 2 microns less then the inner diameter of the cladding; and wherein the conductive members are conductive while applying a voltage of 5000 V to the conductive members and while exposing the cable to a temperature of about 1000° C.; and one or more strength members, each strength member comprising a plurality of inorganic fibers surrounding the conductive members or an inorganic rod.

2. The cable of claim 1, wherein the conductive members are substantially free of bonding between the microwire and the cladding.

3. The cable of claim 1, wherein the metal microwire comprises copper, silver, gold, platinum, tungsten, molybdenum, rhenium, rhenium/platinum alloy, high temperature metals, or an alloys or a composite thereof.

4. The cable of claim 1, wherein the inorganic cladding comprises fused silica, fused quartz, alumina, a glass, $Ti^{4+}$ doped fused silica, $Ce^{4+}$ doped fused silica, phosphorous doped silica, a doped glass, or $F^{-}$ doped silica.

5. The cable of claim 1, wherein the strength member comprises fused synthetic silica, silicon carbide oxide, silicon carbide, or aluminum oxide.

6. The cable of claim 1, wherein the cable further comprises:

a plurality of braided poly(p-phenylene-2,6-benzobisoxazole) fibers forming the outermost layer of the cable.

7. The cable of claim 1, wherein the cable further comprises:

one or more optical fibers.

8. The cable of claim 1, wherein one of the strength members is a spline-shaped member;

wherein the conductive members are positioned between the ridges of the spline; and wherein the ridges protrude from the center of the cable further than the conductive members.

9. The cable of claim 8, wherein the spline comprises silicon carbide, silicon carbide oxide, or a high temperature polymer.

10. The cable of claim 1, wherein the cable has a tensile strength of at least about 70,000 psi while exposing the cable to a temperature of about 1000° C.

11. The cable of claim 1, wherein the diameter of the cable is from about 50 mil to about 100 mil.

* * * * *